United States Patent [19]

Lowenstein

[11] Patent Number: 4,971,138

[45] Date of Patent: Nov. 20, 1990

[54] BLADDER THERMOSYPHON

[75] Inventor: Andrew Lowenstein, Princeton, N.J.

[73] Assignee: Gas Research Institute, Chicago, Ill.

[21] Appl. No.: 461,053

[22] Filed: Jan. 4, 1990

[51] Int. Cl.[5] ..... F28D 15/02

[52] U.S. Cl. ..... 165/46; 165/104.14; 165/104.27; 29/890.032

[58] Field of Search ..... 165/104.27, 32, 46, 165/104.14; 29/890.032

[56] References Cited

FOREIGN PATENT DOCUMENTS 1402789 6/1988 U.S.S.R. ..... 165/46

OTHER PUBLICATIONS

Parasapour, H. B., *Convection Cooling In Small Terminals,* IBM Tech. Disclosure Bulletin, vol. 24, No. 2, Jul. 1981.

*Primary Examiner*—Albert W. Davis, Jr.
*Attorney, Agent, or Firm*—Lorusso & Loud

[57] ABSTRACT

A thermosyphon heat exchanger having evaporator and condenser sections is provided which includes an internal bladder capable of defining an internal volume which is substantially equivalent to the internal volume of the thermosyphon, the bladder containing working fluid which acts to transfer heat being delivered to the evaporator section of the thermosyphon to the condenser section of the thermosyphon. The thermosyphon provided, including the internal bladder, is more easily constructed than known thermosyphons due the ease of pressure relief and there being no requirement of extreme cleanliness within the thermosyphon. Also provided is a method of constructing a thermosyphon in accordance with present thermosyphon.

7 Claims, 4 Drawing Sheets

BLADDER THERMOSYPHON

BACKGROUND OF THE INVENTION

This invention relates to thermosyphon heat exchangers and an improved construction thereof which provides enhanced performance and easier manufacture.

A thermosyphon is a closed end tube, with evaporator and condenser sections, containing a working fluid which during operation exists in both liquid and vapor phases. When sufficient heat is applied to the bottom of the thermosyphon, a pool of liquid at the bottom of the thermosyphon begins to boil. Cooling the top end of the thermosyphon causes vapor generated from the boiling working fluid to condense on the walls of the condenser and, driven by the force of gravity, to drain back to the liquid pool at the bottom. Due to the fact that the working fluid is constantly close to its saturation temperature, the thermosyphon is very effective in transferring large amounts of heat across a small cross-sectional area with only a small drop in temperature.

Thermosyphons powered by gas burners have been successfully tested in home and industrial applications such as space heating. The thermosyphons proposed for these applications may include a series of finned tubes that are each evacuated, and then prior to their being sealed, charged with a working fluid such as water. In use, the tubes are placed with their evaporator sections in one chamber receiving combustion products of a burner. In that chamber, hot combustion gases are blown over the evaporator sections of the tubes. In another chamber, room air to be heated is blown over the condenser sections of the tubes to remove heat from the condensing working fluid.

Due to the chemical properties which govern the operation of thermosyphons, it is crucial to their effective operation that the tubes be evacuated prior to their being charged with working fluid. It is also very important that the inner surfaces of the tubes be kept meticulously clean so that the working fluid wets the evaporator, thereby maintaining a high heat transfer coefficient in this section of the thermosyphon, and so that no non-condensible gases are generated by contaminants during the operation of the thermosyphon.

As a result of these requirements, several problems exist with the manufacture and operation of known thermosyphons. First of all, pressure relief mechanisms, such as known pressure relief caps can have corrosion problems and are extremely unreliable. Both the cost and unreliability of the pressure relief mechanisms can generate equivalent high cost and unreliability in the thermosyphons manufactured using those devices. Secondly, after a thermosyphon tube has been evacuated and charged with a working fluid, it is necessary to braze an end cap on the open end of the tube in order to form a leak tight pressure vessel. This process can also be expensive and may result in contamination from the braze. When a thermosyphon tube is operated with contaminants on its inner surface—e.g., dirt, grease, or oil, several problem areas can arise. The contaminants can act to prevent the working fluid from wetting the evaporator which will thereby degrade the performance of the thermosyphon. Additionally, contaminants can generate non-condensible gases that also degrade thermosyphon performance.

It is therefore an object of the present invention to provide a thermosyphon which is easier and less expensive to manufacture than known thermosyphons.

It is also an object of the present invention to offer a thermosyphon which requires less maintenance provide its operating life than known thermosyphons.

It is yet another object of the present invention to provide a thermosyphon which does not require an inside surface which is meticulously clean.

SUMMARY OF THE INVENTION

The problems of tee prior art are greatly resolved by the device of the present invention which is a thermosyphon comprising an internal bladder. The internal bladder of the present invention simplifies the manufacturing process of a thermosyphon by providing an easy efficient method of pressure relief and eliminating the need for extremely high levels of cleanliness.

In accordance with the present invention, a flexible bladder, capable of withstanding typical thermosyphon operating temperatures, is filled with a charge of working fluid. Air is then removed, as by squeezing the flexible bladder and the bladder is then hermetically sealed. The bladder is then placed inside of a thermosyphon tube with no need to pay particular care to the cleanliness of the inside surface of the thermosyphon tube. The thermosyphon tube is then sealed at both ends with press fit caps with no requirement that the caps form a pressure tight vessel. This is because with the bladder thermosyphon of the present invention it is the bladder that is hermetically sealed rather than the thermosyphon tube. As a result, the expensive brazing process of known thermosyphons is avoided.

The bladder of the present invention is sufficiently flexible that when the thermosyphon is not operating the bladder rests against the inside walls of the thermosyphon tube. When heat is applied to the evaporator section of the thermosyphon it is immediately conducted to the working fluid contained within the bladder. When the working fluid reaches a temperature at which its vapor pressure is greater than ambient vapor pressure, the bladder will inflate to make thermal contact with the entire inside surface of the thermosyphon tube. At this point the bladder thermosyphon of the present invention will function the same as known thermosyphons in that working fluid will receive heat in the evaporator section of the thermosyphon and deliver that heat to the condenser section of the thermosyphon by condensing on the condenser section walls. The bladder is sufficiently thermally conductive so that while the bladder is transferring heat the temperature drop across the bladder is not excessive.

In an alternate embodiment of the present invention, a wettable liner is inserted within the portion of the internal bladder contained in the evaporator section of the thermosyphon tube. This embodiment of the invention has the added benefit of exploiting a non-wettable bladder to permit high condensing heat transfer coefficients in the thermosyphon's condenser section.

In still another embodiment of the present invention, the inside surface of the thermosyphon tube is coated with a thermally conducting paste to enhance the heat transfer from the bladder to the thermosyphon tube wall.

DESCRIPTION OF THE PREFERRED EMBODIMENTS

At the outset the invention is described in its broadest overall aspects with a more detailed description following. In its broadest aspects the present invention is a thermosyphon heat exchanger provided with an internal bladder for the containment of working fluid. The use of the internal bladder provides a thermosyphon that is far more easily manufactured than known thermosyphon heat exchangers and is less prone to problems during operation.

Figure 1:
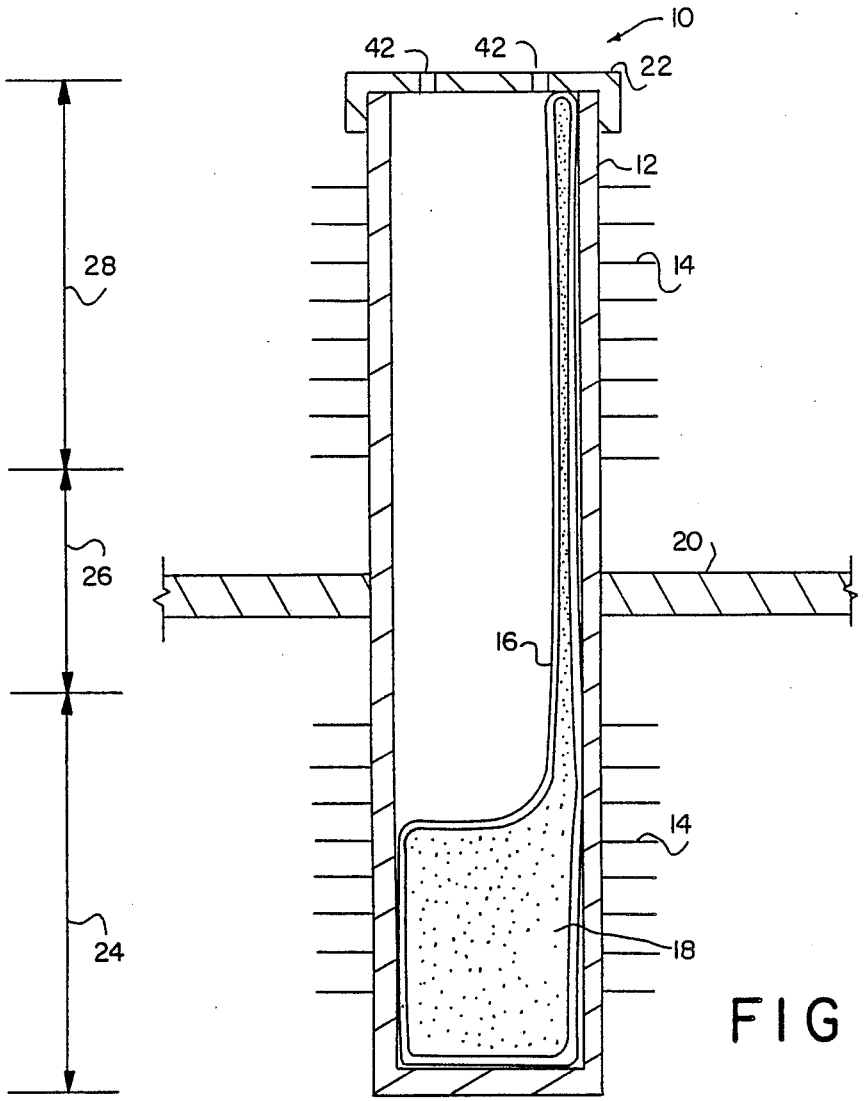
FIG. 1 is a cross-sectional view of a preferred embodiment of the internal bladder thermosyphon of the present invention shown in an off state with the internal bladder relaxed.

In FIG. 1 there is shown a schematic representation of a thermosyphon heat exchanger 10 suitable for use in gas or oil burner space heating applications. It includes a thermosyphon tube 12 with heat fins 14 on it to facilitate heat transfer from the tube 12 to or from the surrounding atmosphere. The thermosyphon tube 12 has three sections: an evaporator section 24, an adiabatic or transition section 26 and a condenser section 28. The thermosyphon heat exchanger 10 in accordance with the present invention further has a flexible internal bladder 16 which contains a charge of working fluid 18.

During construction of the thermosyphon heat exchanger 10 of the present invention, the flexible internal bladder 16 is filled with a charge of working fluid 18 prior to being inserted into the thermosyphon tube 12. After the bladder 16 has been filled with a sufficient charge of working fluid 18, the bladder is then squeezed free of air, so that the bladder 16 defines an internal volume that is substantially equivalent to the volume of working fluid 18 As can be seen in FIG. 1, this volume is considerably smaller than the internal volume of the thermosyphon tube 12. Once the bladder 16 has been squeezed free of air, it is hermetically sealed to form a pressure tight, leak proof containment vessel. The bladder 16 is then inserted into the thermosyphon tube 12 and an end cap 22 is press fit onto the thermosyphon tube 12. Since the bladder 16, rather than the thermosyphon tube 12, provides for the containment of the working fluid 18, there is no need to braze the end cap 22 onto the thermosyphon tube 12. The result is a thermosyphon heat exchanger 10 which has been constructed without the need to use expensive, unreliable pressure relief mechanisms or brazing equipment such as are conventionally used in the construction of thermosyphon heat exchangers.

As the bladder 16 has been squeezed to a size conforming to the volume of the charge of working fluid 18, when the thermosyphon 10 is in an "off" or unheated state the internal bladder 16 primarily occupies only the evaporator section of the thermosyphon tube 10. This is because the bladder 16 is in a relaxed state due to the equal pressures of the working fluid 18 within the bladder 16 and the atmosphere surrounding the bladder within the thermosyphon tube 12. Also, as thermosyphon systems of this type are generally operated vertically with the evaporator section 24 of the thermosyphon tube 12 positioned downward, the force of gravity draws the flexible internal bladder 16 and working fluid 18 into the evaporator section 24.

Figure 2:
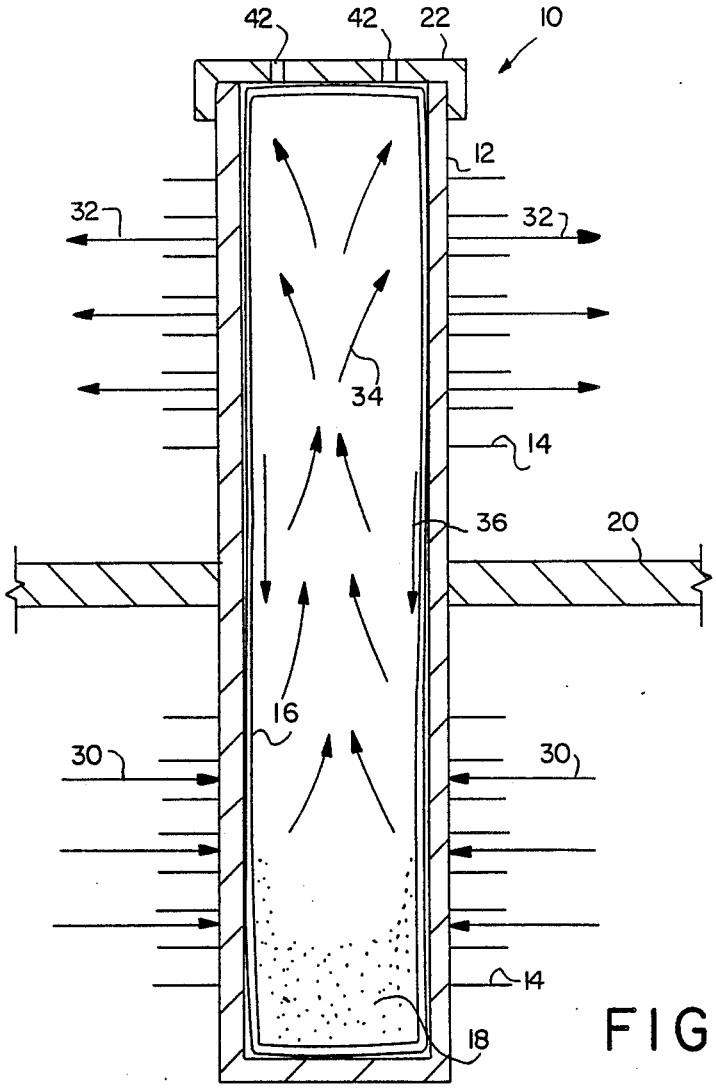
FIG. 2 is a cross-sectional view of a preferred embodiment of the internal bladder thermosyphon of the present invention shown in an on state with the bladder inflated to conform to the inside surface of the thermosyphon tube.

FIG. 2 is a schematic representation of a internal bladder thermosyphon 10 in accordance with the present invention in an "on", or heated state. The thermosyphon tube 12 is placed inside of a heating chamber (not shown) such as a chamber in communication with the exhaust of a gas-fired burner. Within the heating chamber, heat is applied to the evaporator section 24 as indicated by the horizontal arrows 30. The heating chamber is sufficiently sealed that the hot combustion gases in the chamber are separate from the air to be heated which is directed over the condenser section 28 of the thermosyphon tube 12. In the FIGS. 1 and 2, this separation is represented by a divider plate 20.

As a result of exposure to hot gases within the heating chamber, the walls of the evaporator section 24 of the thermosyphon tube 12 become hot. Since the flexible internal bladder 16 is in direct contact with the inside surface of the thermosyphon tube 12 walls, heat received from the heating chamber is immediately transferred to the internal bladder 16 and the working fluid 18. It is important, therefore, that the flexible internal bladder 16 be constructed of a material with high thermal conductivity so that there will not be an excessive temperature drop during this transfer process.

As the temperature of the working fluid 18 begins to rise from heat in the heating chamber being applied in the direction of arrows 30, either the pressure of vapors within the flexible internal bladder 16 or the volume of the bladder 16 will increase proportionally This reaction can be explained by the following equation:

$$PV = nRT$$

where,

P = pressure;
V = volume;
n = number of molecules;
R is a constant; and
T = temperature Accordingly, as the temperature of the working fluid rises, T in the above equation, there must be a proportional increase in either one or a combination of the values on the left side of the above equation because the number of molecules of working fluid, n, remains constant. In the case of a rigid container, volume necessarily remains constant so the pressure inside of the vessel will increase in proportion as its temperature rises. In a flexible container such as the internal bladder 16 of the thermosyphon tube 12, the volume will not remain constant.

In any completely flexible container, the pressure inside of the container at equilibrium must be equal to the pressure outside of the container. The volume of the container will alter itself to maintain this condition. This is illustrated by the inflation of a balloon. As the internal pressure is increased, the volume of the balloon expands to compensate for that increase and maintain equilibrium with the surrounding atmosphere.

With the flexible internal bladder 16 of the present invention, as the temperature of the working fluid 18 increases, the pressure within the bladder 16 will increase as well. As the bladder 16 is flexible, however, whenever the pressure inside of the bladder 16 becomes greater than ambient pressure, the bladder 16 will inflate to increase its volume and maintain equilibrium with ambient pressure. As a result, when heat is applied in the direction of arrows 30 to increase the temperature of the working fluid 18 inside of the bladder 16 to the point of boiling, the bladder 16 will expand until it is restricted from doing so by the thermosyphon tube 12 which is a rigid containment vessel. The flexible internal bladder 16 will expand, therefore, until it is in contact at all points with the inner surface of the thermosyphon tube 12.

In order for the flexible internal bladder 16 to inflate properly, it is important that the thermosyphon tube 12 be provided with a means through which it can breath so that the air contained within the thermosyphon tube 12 can escape as the flexible internal bladder 16 inflates. This can either be provided by allowing gaps in the press fit seal of the end cap 22 of the thermosyphon tube 12 or by providing orifices 42 in the end cap 22 or in the condenser section 28 of the thermosyphon tube 12.

Once the flexible internal bladder 16 has inflated to substantially conform to the internal volume of the thermosyphon tube 12, the thermosyphon heat exchanger 10 of the present invention functions similarly to known thermosyphons. That is, as a result of heating within the heating chamber, the working fluid 18 within the thermosyphon tube 12 is brought to a boil. Upon boiling, the working fluid 18 vaporizes and, due to the resulting vapor being less dense than other liquid in the thermosyphon tube 12, is driven upward in the direction of the vertical arrows 34 toward the condenser section 28 of the thermosyphon tube 12. As a result of air from the space to be heated being circulated over the condenser section 28, the condenser section 28 has a lower temperature than the boiling point of the working fluid 18. This causes the rising vapor bubbles of working fluid 18 to condense onto the walls of the condenser section 28 and into the surrounding liquid that has been drawn upward with the vaporized working fluid 18. As air from the space to be heated passes over the condenser section 28 of the thermosyphon tube 12, heat is transmitted from the thermosyphon tube 12, as represented by vertical arrows 32, to the circulating air. As a result, the relatively cool air is heated and is then directed through ducts, for example, to heat areas such as office or living spaces.

Figure 3:
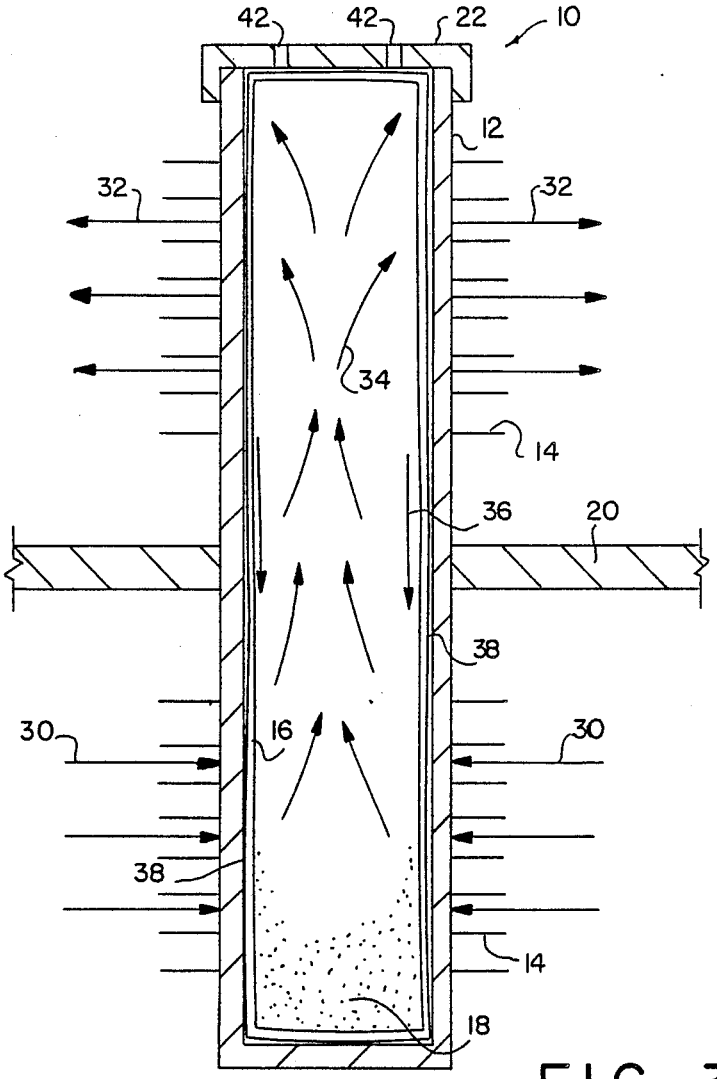
FIG. 3 is cross-sectional view of an alternative embodiment of the internal bladder thermosyphon of the present invention in which the inner surface of the thermosyphon tube is coated with a thermally conductive paste to enhance heat transfer to the thermosyphon tube wall.

As shown in FIG. 3, an alternate embodiment of the present invention, a highly thermally conductive paste 38 is applied between the internal surface of the thermosyphon tube 12 and the flexible internal bladder 16. This paste is provided to ensure good thermal contact at all points between the internal surface of the thermosyphon tube 12 and the flexible bladder 16. In this manner, the thermosyphon heat exchanger of the present invention is able to operate with minimum temperature drop from the working fluid 18 to the air circulating around the condenser section 28.

Figure 4:
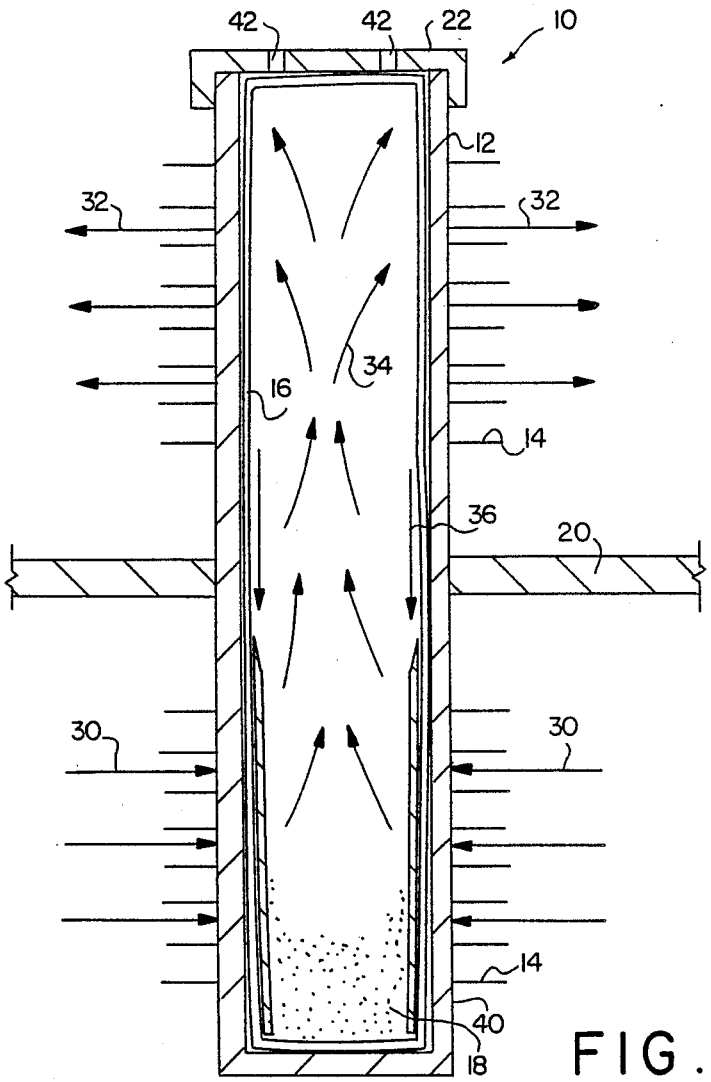
FIG. 4 is a cross-sectional view of another embodiment of the internal bladder thermosyphon of the present invention in which a wettable insert is positioned within the evaporator section of thermosyphon the tube.

In yet another embodiment of the present invention as depicted in FIG. 4, a wettable liner 49 is placed inside of the flexible bladder 16 in the evaporator section 24 to ensure that the flexible bladder 16 is wet by the working fluid 18 which will increase the maximum heat throughput of the thermosyphon. This embodiment of the present invention is able to exploit the benefits of a non-wettable flexible bladder to increase condensing heat transfer coefficients in the thermosyphon's condenser section 28 while receiving heat more efficiently from the heating chamber in which the evaporator section 24 is positioned due to the characteristics of the wettable insert 40.

For the bladder thermosyphon to work properly, the flexible bladder 16 must be constructed of a material that is capable of withstanding typical operating temperatures of the thermosyphon. It is also necessary that the material not react with the working fluid 18. Additionally, the bladder 16 must be constructed of a material that has a sufficiently small thermal resistance so as to not inhibit the flow of heat to the working fluid 18 in the evaporator section 24 or from the working fluid 16 to the air circulating around the condenser section 28. Finally, the material of which the flexible bladder 16 is constructed must not degrade with deformation and thermal cycling. Typical materials which meet all of these requirements and should be good bladder materials are Viton and Teflon which are trademarks of the E.I. DuPont de Nemours Company for a series of fluoroelastomers and tetrafluoroethylene fluorocarbon polymers respectively.

The embodiments described above are but three of several which utilize this invention and are set out here by way of illustration but not of limitation. Many other embodiments which will be readily apparent to those skilled in the art may be made without materially departing from the spirit and scope of this invention. The invention, therefore, is to be defined by the claims that follow.

What is claimed is:

1. A thermosyphon system comprising;

at least one closed end thermosyphon tube with an inner surface defining an internal volume, said thermosyphon tube having an evaporator section at a first end adapted to transfer heat to a working fluid contained within said evaporator section and a condenser section at a second end for receiving heat from said working fluid, said thermosyphon tube also defining a transition section between said condenser section and said evaporator section;

a working fluid within said thermosyphon tube, said working fluid being capable of being heated to form a vapor in said evaporator section for flowing to, and releasing heat at, said condenser section; and an hermetically sealed resilient bladder positioned within said thermosyphon tube and containing said working fluid, said bladder being evacuated prior to being sealed and being capable of expanding, when said working fluid contained within said bladder reaches a temperature such that it has a vapor pressure which is above ambient pressure, to a volume substantially equal to said internal volume of said thermosyphon tube, thereby making thermal contact with said inner surface of said thermosyphon tube to allow said working fluid to receive heat from said evaporator section and deliver heat to said condenser section.

2. The thermosyphon as set forth in claim 1, wherein said at least one thermosyphon tube is provided with orifices in its condenser section through which air contained within said thermosyphon tube can escape as said bladder inflates.

3. The thermosyphon as set forth in claim 1, wherein said inner surface of said thermosyphon tube is coated with a thermally conductive paste to facilitate heat transfer between said bladder and said inner surface.

4. The thermosyphon as set forth in claim 1, including a wettable liner within said bladder in said evaporator section of said thermosyphon tube to insure that said bladder is wet by said working fluid in said evaporator section.

5. The thermosyphon as set forth in claim 4, including a non-wettable liner with sad bladder in said condenser section of said thermosyphon tube to increase condensing heat transfer coefficients in the condenser section of the thermosyphon tube.

6. A method of constructing a thermosyphon heat exchanger comprising:

loading a first volume of working fluid into a resilient bladder capable of expanding to define a second volume;

evacuating liquid and gases other than said working fluid from said bladder so that said bladder defines a volume equal to said first volume;

hermetically sealing said bladder to prevent said working fluid from escaping from said bladder and to prevent contaminants from entering into said bladder;

positioning said hermetically sealed, bladder within a thermosyphon tube which is open at a first end, said thermosyphon tube having an inner surface which defines an internal volume which is greater than said first volume and less than said second volume; and fitting an end cap on said first end of said thermosyphon tube.

7. A method of heating space comprising:

loading a first volume of working fluid into a resilient bladder capable of expanding to define a second volume;

evacuating liquids and gases other than said working fluid from said bladder so that said bladder defines a volume equal to said first volume;

hermetically sealing said bladder to prevent said working fluid from escaping from said bladder and to prevent contaminants from entering into said bladder;

positioning said hermetically sealed bladder within a thermosyphon tube which has an evaporator section at a first end and a condenser section at a second end, said thermosyphon tube being open at said second end and having an inner surface which defines a third internal volume which is greater than said first volume and less than said second volume;

fitting an end cap on said second end of said thermosyphon tube;

positioning said thermosyphon tube vertically to orient said evaporator section downward;

placing said evaporator section within a heating chamber to receive products of combustion from a burner to cause said working fluid to boil so that the vapor pressure of said working fluid exceeds ambient pressure, thereby causing said bladder to inflate to said third volume; and circulating air from said space to be heated over said condenser section of said thermosyphon tube to allow said air to remove heat from said thermosyphon tube and to cause vapor within said bladder to condense and thereafter, driven by the force of gravity, to return to said evaporator section of said thermosyphon tube.

* * * * *